US005967102A

United States Patent [19]

Huang

[11] Patent Number: 5,967,102

[45] Date of Patent: Oct. 19, 1999

[54] COMBUSTION ENGINE CONSTRUCTION

[76] Inventor: Shih-Pin Huang, No. 12, Lane 226, An Kang Rd., Taipei, Taiwan

[21] Appl. No.: 09/055,885

[22] Filed: Apr. 6, 1998

[30] Foreign Application Priority Data

Nov. 15, 1997 [TW] Taiwan ..... 86117085

[51] Int. Cl.[6] ..... F02B 57/00

[52] U.S. Cl. ..... 123/43 R; 123/44 D

[58] Field of Search ..... 123/43 R, 44 D

[56] References Cited

U.S. PATENT DOCUMENTS

| | | | |
|---|---|---|---|
| 2,990,820 | 7/1961 | Saijo | 123/44 D |
| 4,166,438 | 9/1979 | Gottschalk | 123/44 D |
| 4,741,300 | 5/1988 | Benson | 123/44 D |
| 5,123,394 | 6/1992 | Ogren | 123/44 D |

FOREIGN PATENT DOCUMENTS

| | | | |
|---|---|---|---|
| 329203 | 11/1920 | Germany | 123/44 D |
| 601657 | 12/1977 | Switzerland | 123/44 D |

*Primary Examiner*—Michael Koczo
*Attorney, Agent, or Firm*—Alan Kamrath

[57] ABSTRACT

A rotary combustion engine construction includes an engine block (20) defining a cylindrical inner space (22) in which a toothed ring portion is integrally attached with the engine block (20), and a cylindrical block (40) rotatably and snugly fitted in the cylindrical inner space (22) of the engine block (20). A number of spark plugs (30) are installed on the engine block (20) at angular intervals. The cylindrical block (40) defines a number of cylinder bores (48*a*) therein along a circumferential portion thereof to each receive a piston (60) which is pivotally attached with a connecting rod (50) which is pivotally connected with a crank (52) which is coaxially and fixedly connected with a pinion (80) meshing with the toothed ring portion (20*a*) formed with the engine block (20), so that the piston (60) may conduct reciprocal movement along the respective cylinder bore (48*a*) and thus the pinion (80) may be driven into rotation that allows the cylindrical block (20) together with an output axle (100) to rotate with respect to the engine block (20) to supply a rotation mechanical power output.

9 Claims, 11 Drawing Sheets

COMBUSTION ENGINE CONSTRUCTION

BACKGROUND OF THE INVENTION

The present invention relates to a rotary combustion engine construction, and more particularly to a rotary combustion engine construction that can be fabricated in a small size and/or light weight for saving fuel without compromising the structural strength.

During the history of the automotive engines, many proposals have been made to replace the conventional reciprocating motion of a piston with a rotary motion of a piston. It was not until the late 1950s that rotary piston engine theory began to be successfully translated into practice, as exemplified by the Wankel engine. Even so the only company now making a production Wankel engined car is the Japanese manufacturer of Mazda cars, although engines operating on the Wankel principle may be found in other transportation and industrial applications. Although the Wankel engine has the claimed advantages that it occupies less space and offers a reduction in weight relative to its power output, it compromises the combustion efficiency due to the moving combustion space of this type of engine lacking compactness.

Another type of rotary engine is the gas-turbine engine, which has been successfully fitted in airplanes, helicopters, and electric generating systems. As to this type of engine, it operates mostly at a constant speed, so that it does not perform well in automotive vehicles. One reason for this unsuitable performance is a noticeable delay in acceleration after the driver has depressed the throttle. Also, the power-turbine section, which gets very hot and runs at a very high speed, is made of expensive materials. This makes the gas-turbine engine cost much more than a comparable piston engine in the fabrication, and as a result there is no gas-turbine commercially available.

In view of the foregoing, the applicant has invented a rotary combustion engine construction, which has the advantage of space and/or weight reduction without compromising the combustion efficiency as existing in the Wankel engine.

BRIEF SUMMARY OF THE INVENTION

The primary object of the present invention is to provide a rotary combustion engine construction, which comprises an engine block and a cylindrical block. The engine block defines a cylindrical inner space in which a toothed ring portion is integrally attached with the engine block. The engine block is installed with a plurality of spark plugs and defines a plurality of exhaust ports and a plurality of intake ports communicating with the cylindrical inner space. The cylindrical block is rotatably and snugly fitted in the cylindrical inner space of the engine block. The cylindrical block defines a plurality of cylinder bores therein along a circumferential portion thereof to each receive a piston therein. Each cylinder bore is accessible to the spark plug, the exhaust ports, and the intake ports upon rotation of the cylindrical block. The piston is pivotally attached with a connecting rod which is pivotally connected with a crank which is coaxially and pivotally connected with a pinion which in turn meshes with the toothed ring portion of the engine block. In such an arrangement, each piston is allowed to conduct reciprocal movement action including a power stroke movement, an exhaust movement, an intake movement, and a compression stroke movement, along the respective cylinder, which in turn drives the crank to rotate integrally with the pinion through the connecting rod, which in turn drives the cylindrical block to rotate integrally with the output shaft connected thereto. Thus, the rotation of the pinion may cause the cylindrical block together with the output axle to rotate with respect to the engine block to supply a rotational mechanical power output.

Another object of the present invention is to provide a rotary combustion engine construction, which comprises an engine block, a cylindrical block, a plurality of pistons, and a plurality of pinions. The engine block defines a cylindrical inner space in which a central toothed ring portion is integrally attached with the engine block, a plurality of exhaust ports, and a plurality of intake ports. The plurality of threaded holes are evenly distributed along a periphery of the engine block and communicate with the cylindrical space to respectively receive a spark plug therein. The plurality of intake ports are evenly distributed along the periphery of the engine block respectively corresponding to the plurality of spark plugs. The plurality of intake ports are evenly distributed along the periphery of the engine block respectively corresponding to the plurality of the spark plugs. Each exhaust port is arranged at a position following one of the spark plugs whilst each intake port is arranged at a position following one of the exhaust ports and thus is adjacent to a subsequent spark plug. The cylindrical block is rotatably and snugly fitted in the cylindrical inner space of the engine block. The cylindrical block has a circumferential portion and a central hub portion connected with an output axle and thus defines a ring-shaped recess between the central hub portion and the circumferential portion. The circumferential portion of the cylindrical block defines a plurality of chambers evenly distributed therealong. Each chamber includes a crank-receiving space portion and a cylinder bore portion communicating with the crank-receiving space portion. The plurality of pistons, which are each pivotally attached with a respective connecting rod, are respectively installed in the cylinder bore portions of the chambers. Each connecting rod is pivotally connected with a crank via a crank pin mounted in the respective crank-receiving space portion above a bottom portion of the cylindrical block which defines the ring-shaped recess and each crank-receiving space portion. The plurality of pinions are each coaxially and fixedly mounted with the respective crank via a stub. The pinions are each located below the bottom portion of the cylindrical block to mesh with the central toothed ring portion attached with the engine block. In such an arrangement, each piston is allowed to conduct reciprocal movement action including a power stroke movement, an exhaust stroke movement, an intake stroke movement, and a compression stroke movement, which in turn drives the respective crank to rotate integrally with the respective pinion through the respective connecting rod, which in turn drives the cylindrical block to rotate integrally with the output axle. Thus, the rotation of the pinions causes the cylindrical block together with the output axle to rotate with respect to the engine block to supply a rotational mechanical power output.

Other novel features and advantages of the invention will become more apparent from the following detailed description when taken in conjunction with the accompanying drawings

DETAILED DESCRIPTION OF THE PREFERRED EMBODIMENT

Figure 1:
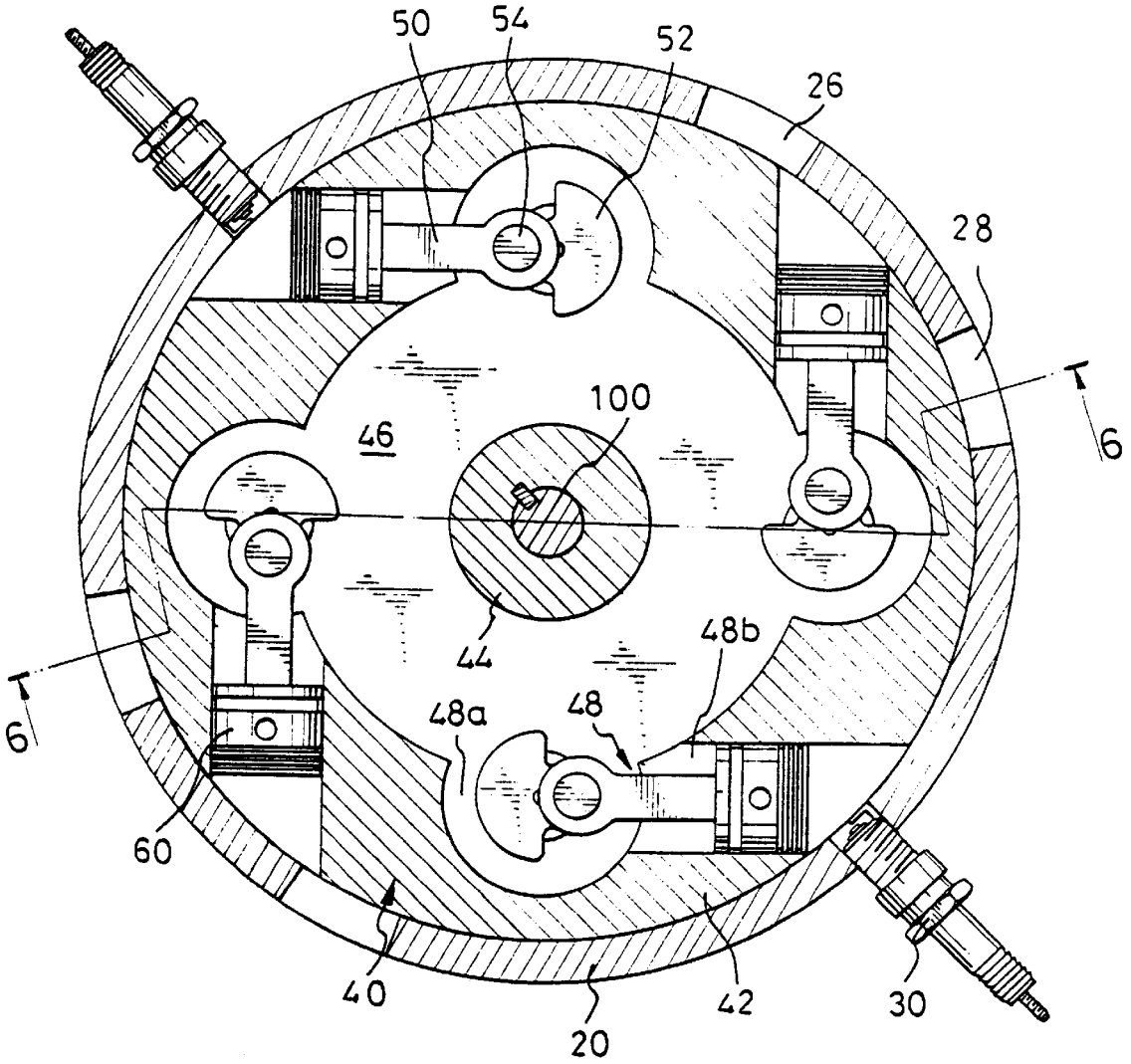
FIG. 1 is a schematically sectional view of a rotary combustion engine in accordance with the present invention, in which a cylindrical block thereof is at a first position.
Figure 6:
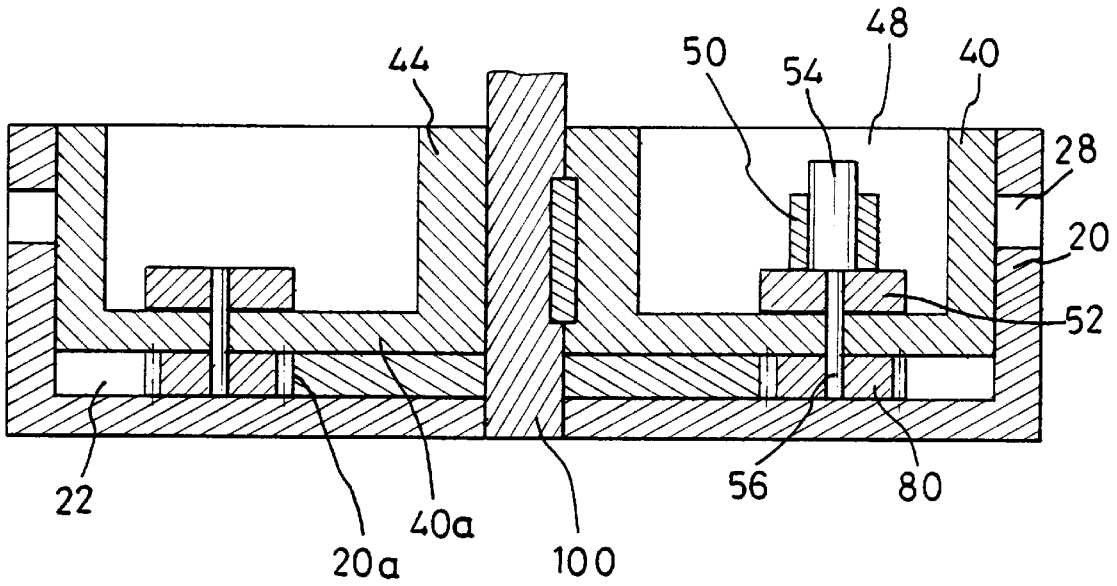
FIG. 6 is a cross-sectional view of the rotary combustion engine construction taken along line 6—6 of FIG. 1.
Figure 8:
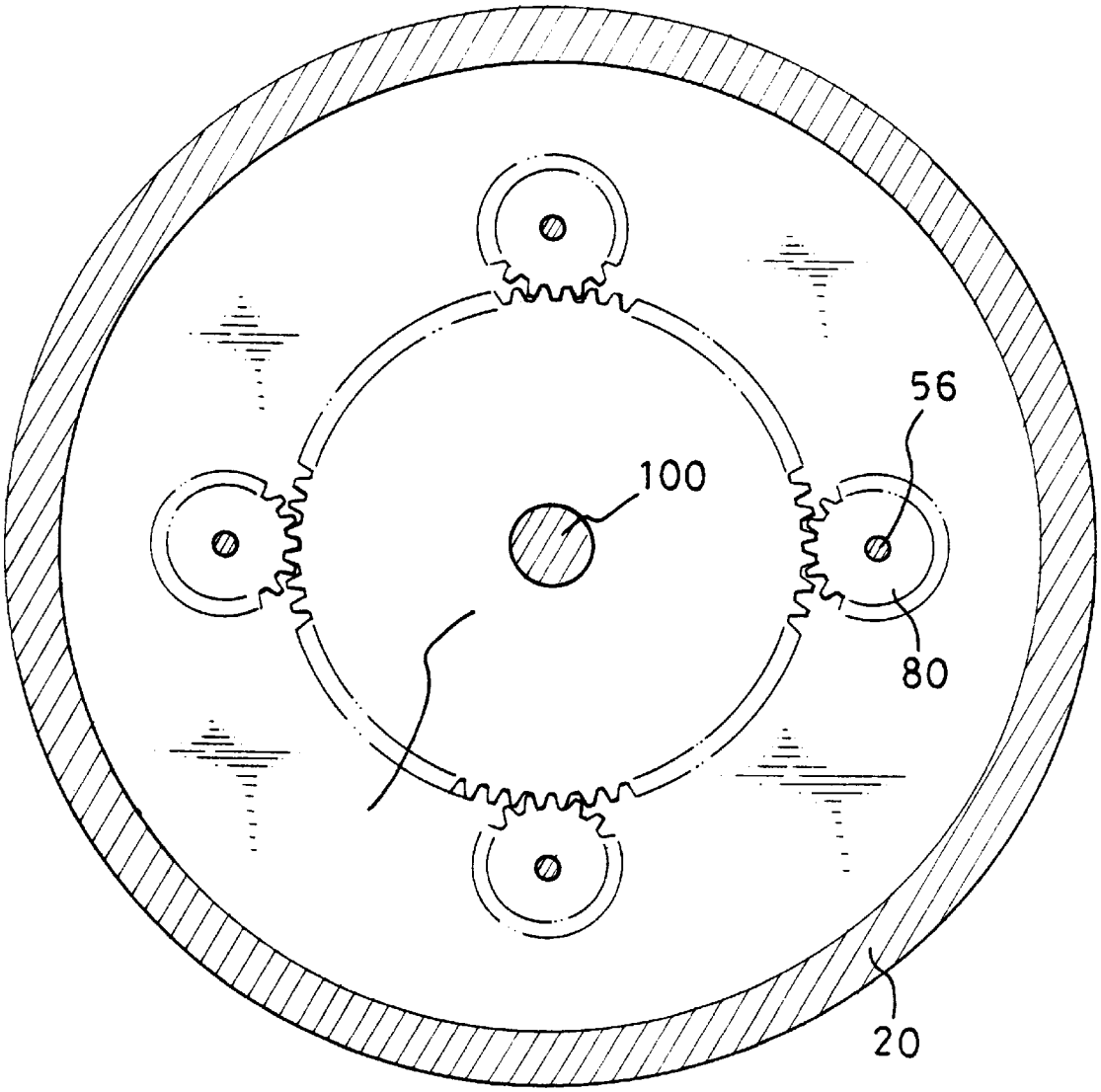
FIG. 8 is a schematically sectional view of the rotary combustion engine construction in which a toothed ring portion of an engine block is in mesh with a plurality of pinions.
Figure 11:
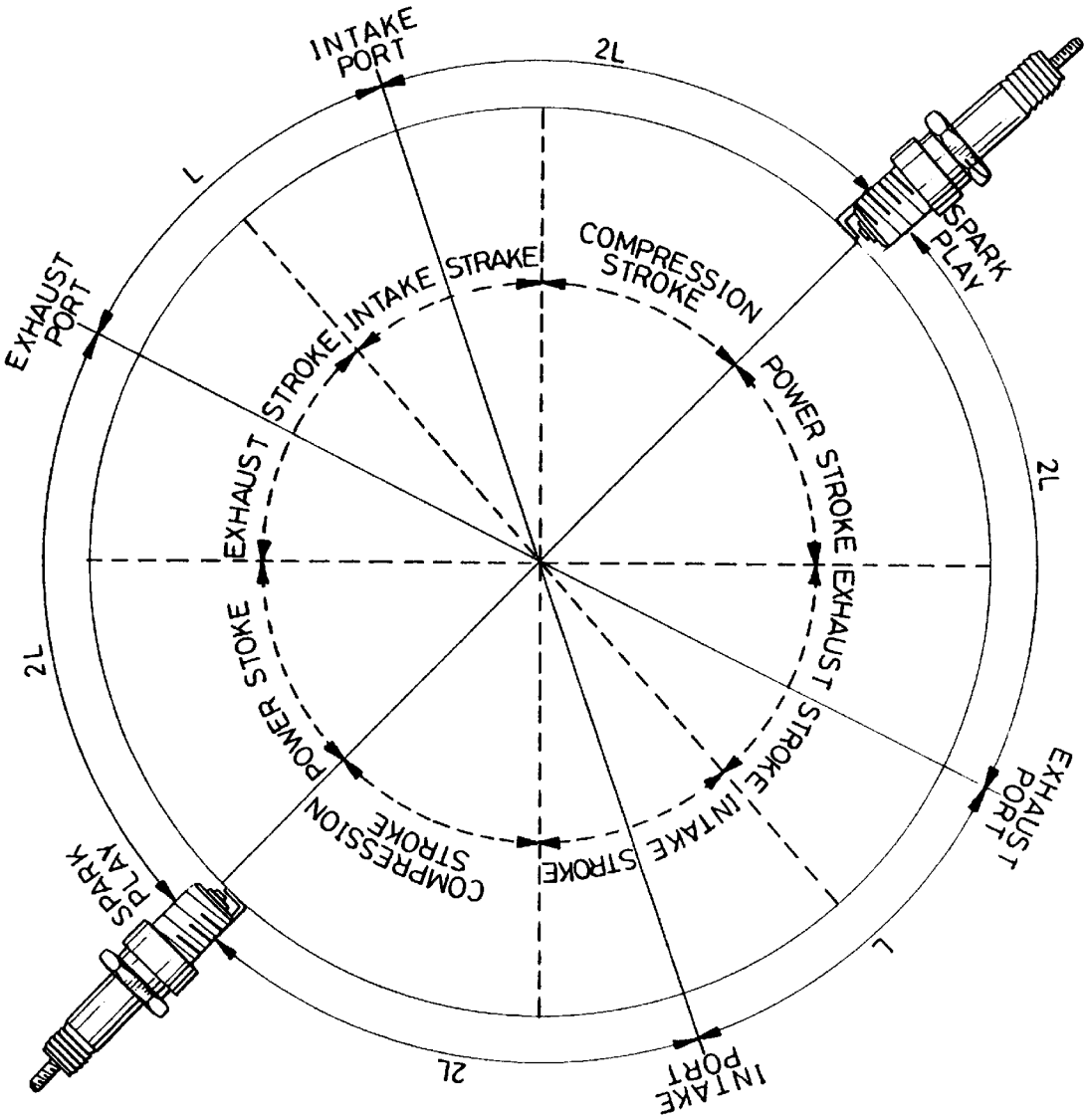
FIG. 11 is a typical timing diagram illustrating the operating process of the present invention

Referring to FIGS. 1, 6 and 8, a rotary combustion engine construction in accordance with the present invention comprises an engine block 20, a cylindrical block 40, a plurality of pistons 60 (the figure showing 4 pistons), and a plurality of pinions 80 (see FIGS. 6 and 8). The engine block 20 defines a cylindrical inner space 22 (see FIG. 6), a plurality of threaded holes 24, a plurality of exhaust ports 26, and a plurality of intake ports 28. Typically, the quantity of the spark plugs 30, the quantity of the intake ports 28, and the quantity of the exhaust ports 26 are the same, the quantity of either of which is half of the quantity of the pistons 60. The engine block 20 is integrally attached with a central toothed ring portion 20*a* in the cylinder space 22 of the engine block 20. The plurality of threaded holes 24, each of which communicates with the cylindrical inner space 22, are distributed along a periphery of the engine block 20 to respectively receive a spark plug 30 therein. The plurality of exhaust ports 26, respectively corresponding to the plurality of spark plugs, are evenly distributed along the periphery of the engine block 20. The plurality of intake ports 28, also respectively corresponding to the spark plugs 30, are evenly distributed along the periphery of the engine block 20. As can be seen in FIG. 1, each exhaust port 26 is arranged at a position following one of the plurality of spark plugs 30 whilst each intake port 28 is arranged at a position following one of the plurality of exhaust ports 26 and thus is adjacent to a subsequent spark plug 30. Typically, the angular distance between a spark plug 30 and a following exhaust port 26 is substantially twice of the angular distance between the said following exhaust 26 and a following intake port 28, and substantially equals the angular distance between the said following intake port 28 and a subsequent spark plug 30 following the said following intake port 28 (see FIG. 11).

The cylindrical block 40, which is rotatably and snugly fitted in the cylindrical inner space 22 of the engine block 20, has a circumferential portion 42 and a central hub portion 44 connected with an output axle 100 and thus defines a ring-shaped recess 46 between the central hub portion 44 and the circumferential portion 42 of the cylindrical block 40. The circumferential portion 42 of the cylindrical block 40 defines a plurality of chambers 48 evenly distributed therealong, each chamber 48 including a crank-receiving space portion 48*a* and a cylinder bore portion 48*b* communicating with the crank-receiving space portion 48*a* (see FIG. 1).

The plurality of pistons 60, each of which is pivotally attached with a connecting rod 50, are respectively installed in the cylinder bore portions 48*b* of the chambers 48, wherein each connecting rod 50 is pivotally connected with a crank 52 via a crank pin 54 mounted in a respective crank-receiving space portion 48*a* above a bottom portion 40*a* of the cylindrical block 40, which defines the ring-shaped recess 46 and each crank-receiving space portion 48*a* (see FIGS. 1 and 6).

Figure 7:
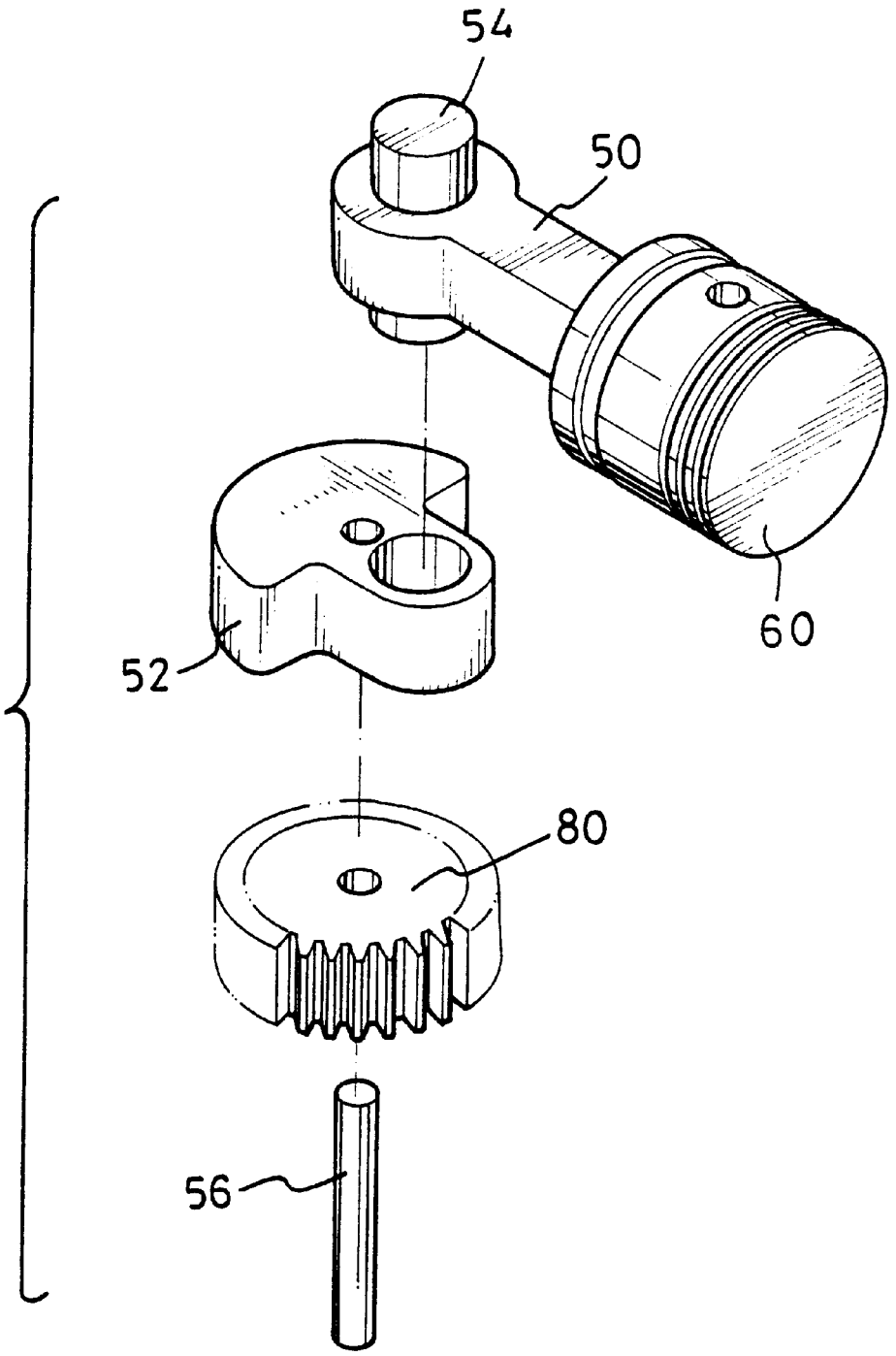
FIG. 7 is a partially exploded view of the rotary combustion engine construction.

Referring to FIGS. 6, 7 and 8, the plurality of pinions 80 are each coaxially and fixedly mounted with a crank 52 via a stub 56. The pinions 80 are each below the bottom portion 40*a* of the cylindrical block to mesh with the central toothed ring portion 20*a* attached integrally with the engine block 20.

Figure 2:
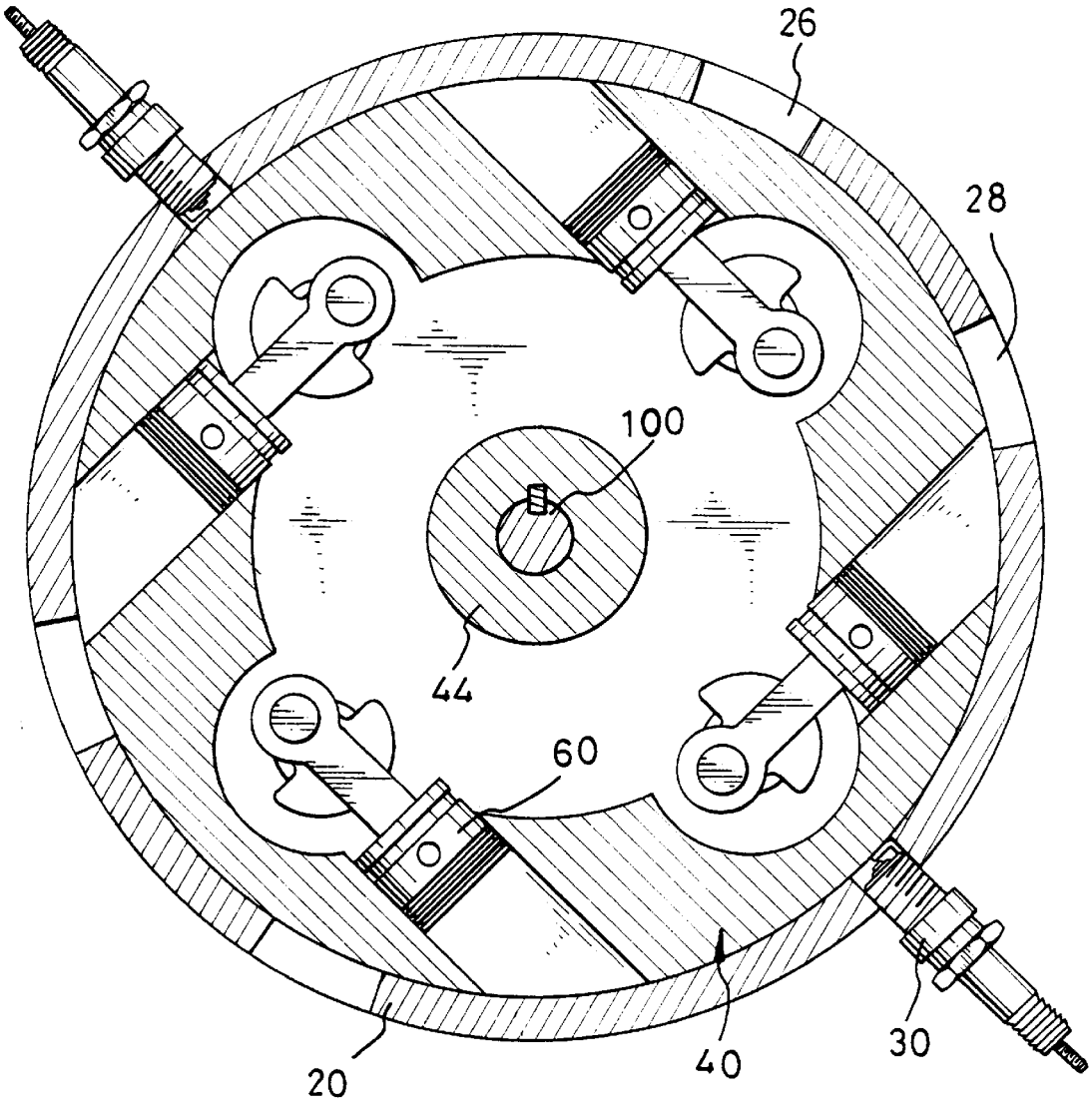
FIG. 2 is a schematically sectional view of the rotary combustion engine construction in which the cylindrical block thereof is at a second position.
Figure 3:
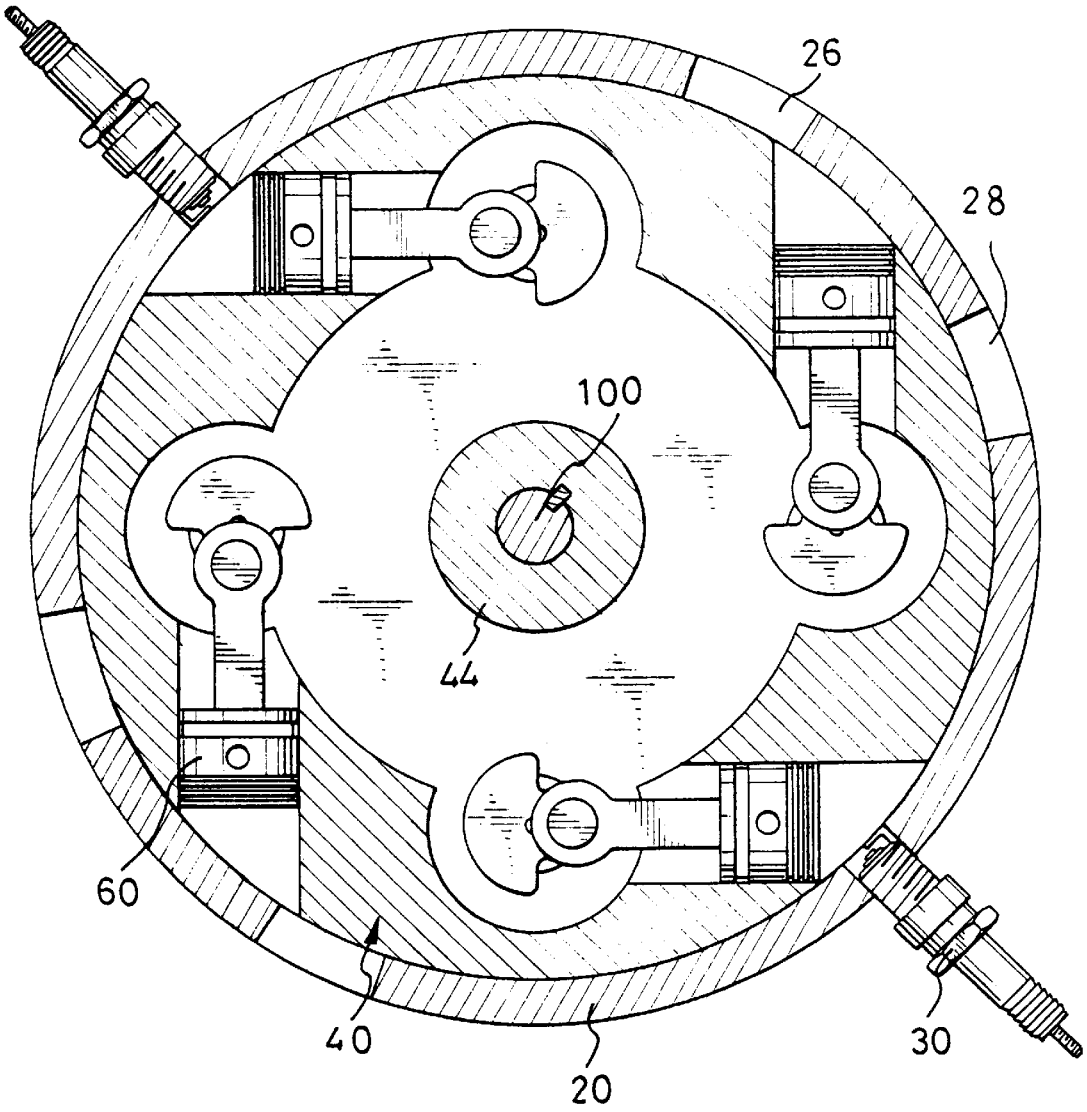
FIG. 3 is a schematically sectional view of the rotary combustion engine construction in which the cylindrical block thereof is at a third position.
Figure 4:
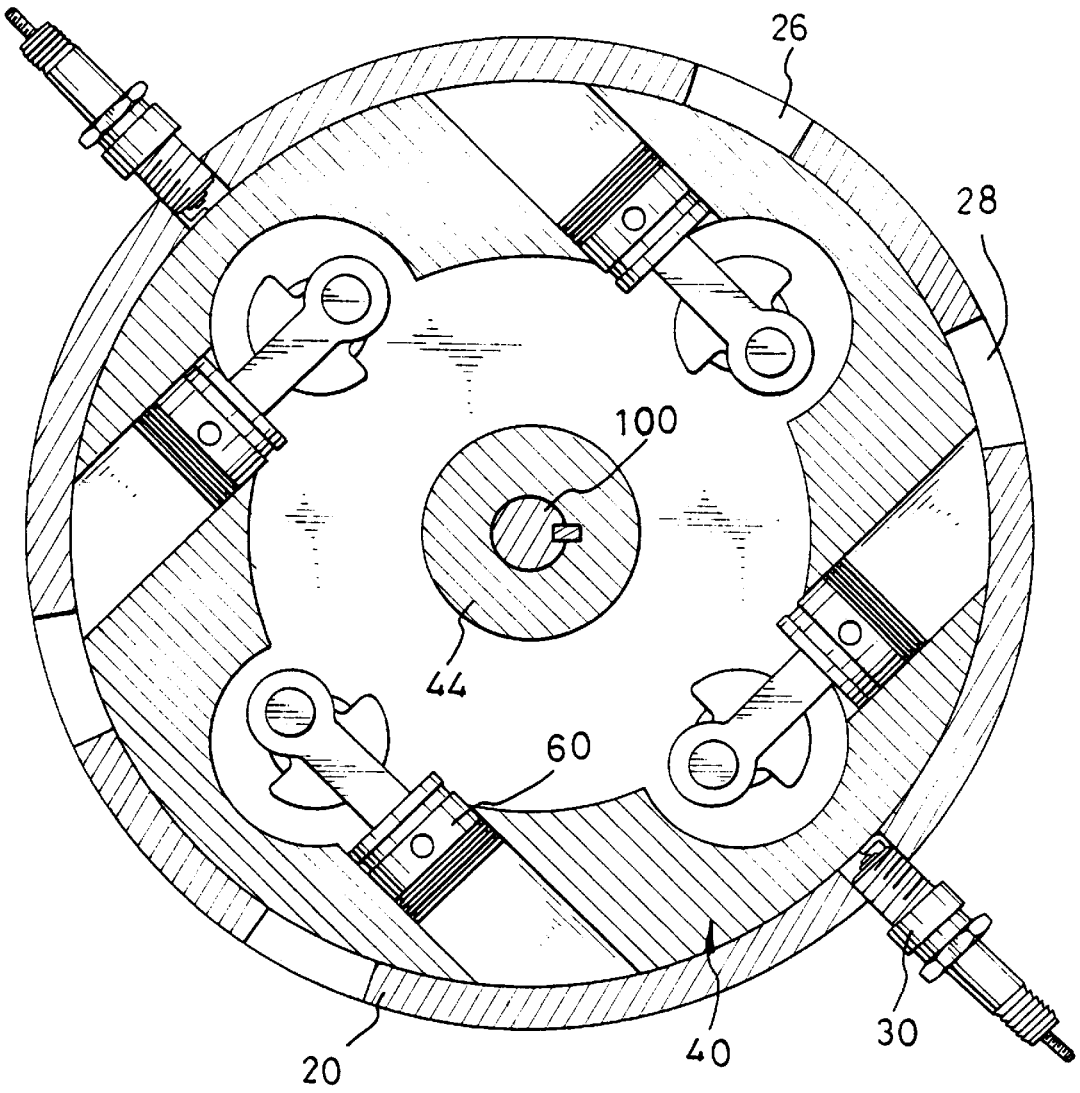
FIG. 4 is a schematically sectional view of the rotary combustion engine construction in which the cylindrical block is at a fourth position.
Figure 5:
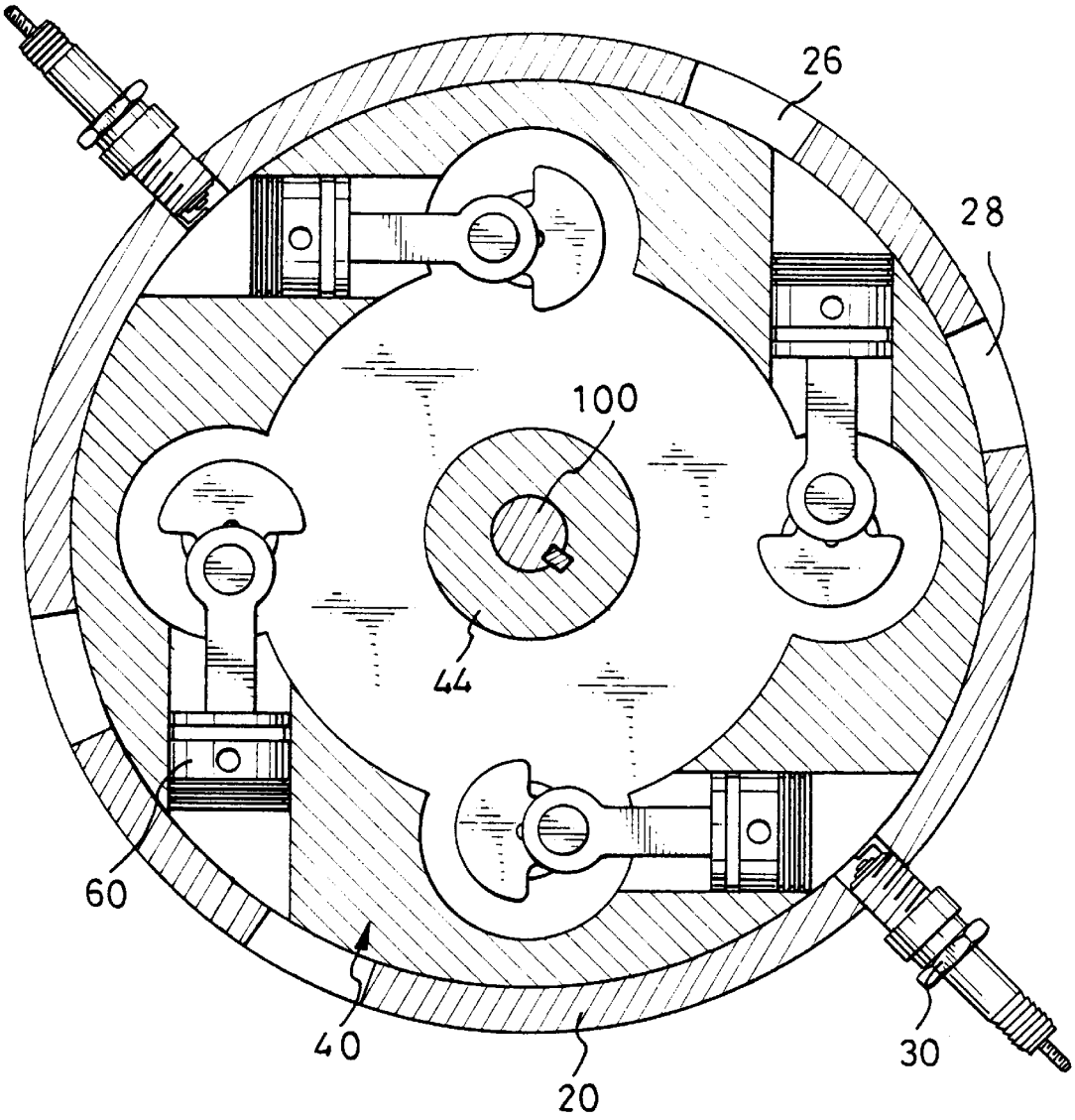
FIG. 5 is a schematically sectional view of the rotary combustion engine construction in which the cylindrical block is at a fifth position.

In operation, the pistons 60 installed in the cylindrical block 40 are each allowed to conduct a four-stroke-cycle action, namely, a power stroke, an exhaust stroke, a intake stroke, and a compression stroke. The stroke actions of the pistons 60 are each coordinated with each other in a manner that each piston 60 is allowed to alternatively deliver partial of a rotational mechanical power to the output axle 100. More specifically, once the rotary combustion engine is started, when the cylindrical block 40 arrives at a first position (see FIG. 1), each cylinder bore portion 48*b* of two of the chambers 48 ( being positioned opposite to each other as shown in the figure) and an associated piston 60 installed therein may access one of the spark plugs 30 to be ready for a power stroke. Referring to FIG. 2, when the cylindrical block 40 arrives at a second position, the associated piston 60 installed in each cylinder bore portion 48*b* of the two chambers 48 has substantially completed a power stroke to be ready for an exhaust stroke, thus gaining access to one of the exhaust ports 26. Referring to FIG. 3, when the cylindrical block 40 arrives at a third position, the associated piston installed in each cylinder bore portion 48*b* of the two chambers 48 has substantially completed an exhaust stroke to be ready for an intake stroke, thus being accessible to one of the intake ports 28. Referring to FIG. 4, when the cylindrical block 40 arrives at a fourth position, the associated piston 60 installed in each cylinder bore portion 48*b* of the two chambers 48 has substantially completed an intake stroke to be ready for a compression stroke. Referring to FIG. 5, when the cylindrical block 40 arrives at a fifth position, the associated piston 60 installed in each cylinder bore portion 48*b* of the two chambers 48 has substantially completed a compression stroke and may arrive at a subsequent spark plug 30 to be ready for a subsequent power stroke. Thereby, each piston 60 is allowed to conduct reciprocal movement along a respective cylinder bore portion 48*b*, which is in turn drives a respective crank 52 to rotate integrally with a respective pinion 80 through a respective connecting rod 50, which in turn drives the cylindrical block 20 to rotate integrally with the output shaft 100 with respect to the engine block 20 being kept stationary, whereby the rotation of the pinions 80 causes the cylindrical block 40 together with the output axle 100 (see FIGS. 1–6) to rotate with respect to the engine block 20 to supply a rotational mechanical power.

Figure 9:
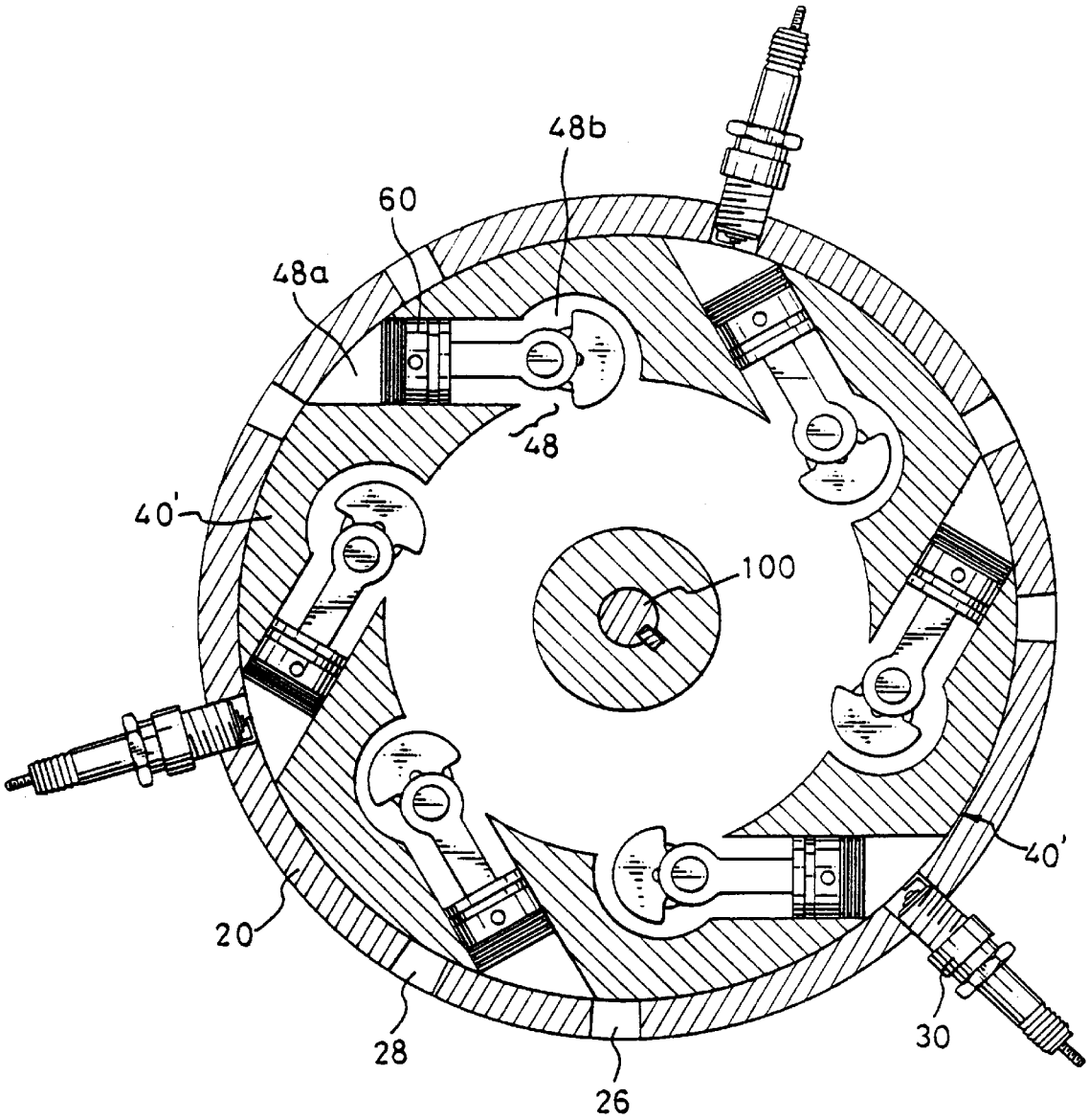
FIG. 9 is a modified embodiment of the rotary combustion engine construction in accordance with the present invention.
Figure 10:
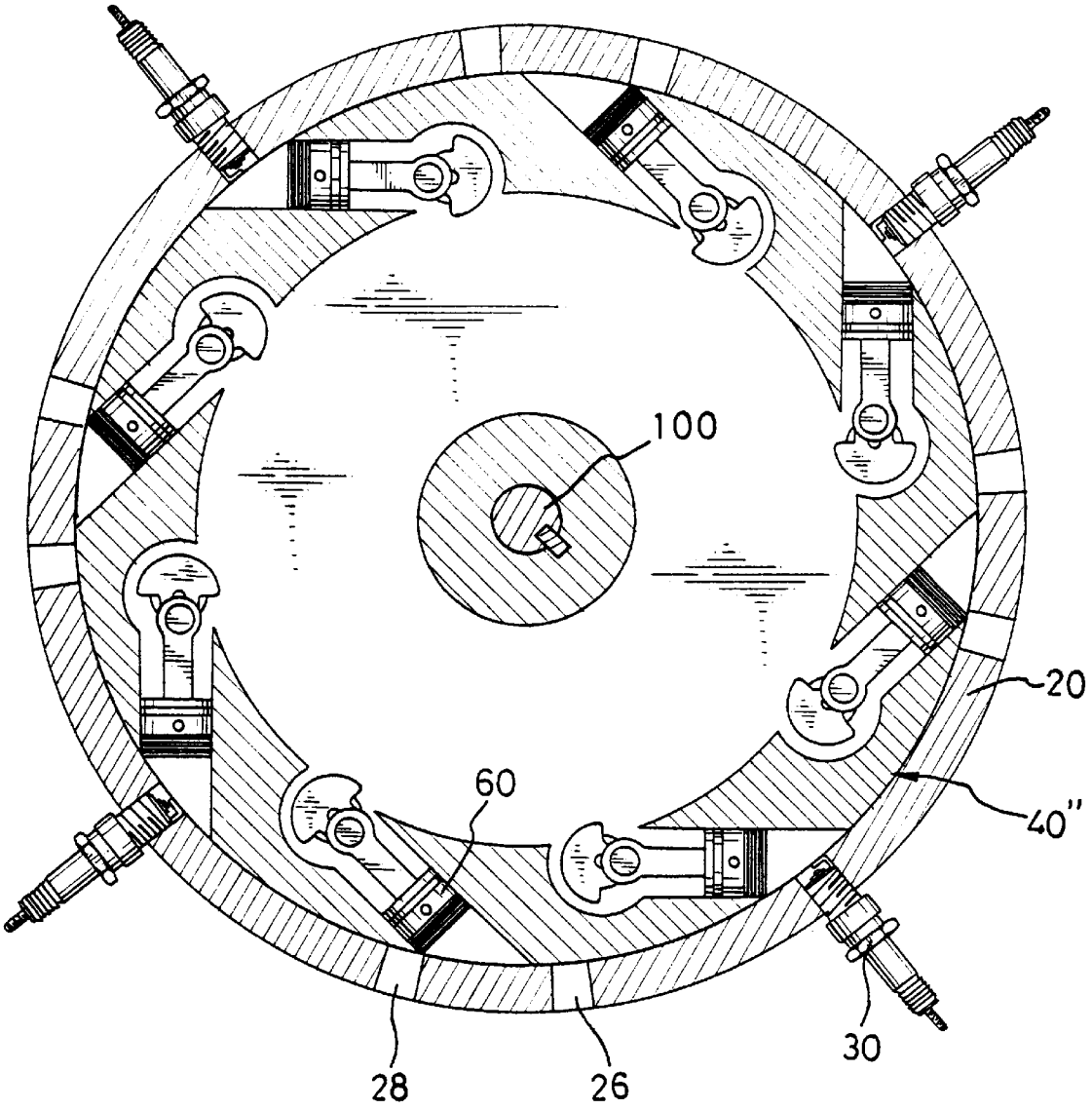
FIG. 10 is a second modified embodiment of the rotary combustion engine construction in accordance with the present invention.

Although the rotary combustion engine construction described above is only shown with four pistons, more or fewer than four pistons are still permitted, as they may be installed in a cylindrical block with more or fewer chambers to achieve the purpose of the present example. For example, as shown in FIG. 9, there are six pistons 60 respectively installed in the cylinder bore portions 48*b* defined in a cylindrical block 40* with six chambers 48; as shown in FIG. 10, there are eight pistons 60 respectively installed in the cylinder bore portions 48*b* defined in a cylindrical block 40* with eight chambers 48.

Referring back to FIG. 8, the rotating speed of the cylindrical block 40 can be controlled from a selection of the gear ratio of the toothed ring portion 20*a* and one of the pinions 80, so that the rotary combustion engine construction does not need an additional speed-reducing device to provide a suitable rotation speed to a transmission input shaft of a vehicle or an electrical generator. Furthermore, the gear ratio may be selected in combination with a selection of the quantity of pistons 60, the dimension of the cylindrical block 40, and the spacing and locating of the exhaust ports 26, the intake ports 28, and the spark plugs 30, so that a rotational mechanical power of a desired rotational mechanical power from the output axle 100 can be obtained.

As a summary, the present invention has the following advantages:

(1) since the power stroke movement of the piston is mostly converted to a rotational movement of the cylindrical block 20, the impact caused by the power stroke can be reduced significantly, thereby increasing the life span of a combustion engine;

(2) since the power stroke movements of the pistons of the present invention are almost converted to a rotational movement of the cylindrical block 20, the rotary combustion engine construction of the present invention may produce a power output greater than a conventional reciprocal combustion engine, and thus the present invention is allowed to be fabricated in a smaller size and/or a weight under a given power output, thus saving fuel; and (3) since the rotary combustion engine construction of the present invention need not employ valves including intake valves and exhaust valves as employed in conventional reciprocal combustion engine constructions, valve damage is eliminated.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

What is claimed is:

1. A rotary combustion engine construction comprising, in combination:

an engine block defining a cylindrical inner space, a central toothed ring portion, a plurality of exhaust ports, a plurality of threaded holes, and a plurality of intake ports, wherein said plurality of threaded holes are evenly distributed along a periphery of said engine block and communicating with said cylindrical space to respectively receive a spark plug therein, said plurality of exhaust ports being evenly distributed along the periphery of said engine block and respectively corresponding to said plurality of spark plugs, said plurality of intake ports being evenly distributed along the periphery of said engine block and respectively corresponding to said plurality of spark plugs, each said exhaust port being arranged following one of said spark plugs whilst each said intake port: being arranged following one of said exhaust ports and thus being adjacent to a subsequent spark plug;

a cylindrical block rotatably and snugly fitted in said cylindrical inner space of said engine block, said cylindrical block having a circumferential portion and a central hub portion connected with an output axle and thus defining a ring-shaped recess between said central hub portion and said circumferential portion, said circumferential portion of said cylindrical block defining a plurality of chambers evenly distributed therealong, each chamber including a crank-receiving space portion and a cylinder bore portion communicating with said crank-receiving space portion;

a plurality of pistons, each of which is pivotally attached with a connecting rod, respectively installed in the cylinder bore portions of said chambers, each connecting rod being pivotally connected with a crank via a crankpin mounted in the respective crank-receiving space portion above a bottom portion of said cylindrical block which defines said ring-shaped recess and each said crank-receiving space portion; and a plurality of pinions, each being coaxially and fixedly mounted with the respective crank via a stub, each pinion being located below the bottom portion of said cylindrical block to mesh with said central toothed ring portion formed integrally with said engine block; whereby each piston is allowed to conduct reciprocal movement action including a power stroke movement, an exhaust stroke movement, an intake stroke movement, and a compression stroke movement, along the respective cylinder bore potion, which in turn drives the respective crank to rotate integrally with the respective pinion through the respective connecting rod, which in turn drives said cylindrical block to rotate integrally with said output axle with respect to said engine block, whereby the rotation of said pinions may cause said cylindrical block together with said output axle to rotate with respect to said engine block to supply a rotational mechanical power output.

2. A rotary combustion engine construction as recited in claim 1, wherein when said cylindrical block arrives at a first position, each cylindrical bore portion of at least one of said chambers and each associated piston installed therein are allowed to access one of said spark plugs to be ready for a power stroke; when said cylindrical block arrives at a second position, each associated piston installed in each cylinder bore portion of said at least one of said chambers has substantially completed a power stroke to be ready for an exhaust stroke, thus being accessible to one of said exhaust ports; when said cylindrical block arrives at a third position, each associated piston installed in each cylinder bore portion of said at least one of said chambers has substantially completed an exhaust stroke to be ready for an intake stroke, thus being accessible to one of said intake ports; when said cylindrical block arrives at a fourth position, each associated piston installed in each cylindrical bore portion of said at least one of said chambers has substantially completed an intake stroke to be ready for a compression stroke; when said cylindrical block arrives at a fifth position, each associated piston installed in each cylinder bore portion of said at least one of said chambers has substantially completed a compression stroke to be ready for a subsequent power stroke.

3. A rotary combustion engine construction as recited in claim 2, wherein the quantity of said spark plugs, the quantity of said intake ports, and the quantity of said exhaust ports are the same, the quantity of either of which is half of the quantity of said chambers defined in said cylindrical block.

4. A rotary combustion engine construction as recited in claim 3, wherein the rotational speed of said cylindrical block corresponds to the gear ratio of said toothed ring portion of said engine block and one of said pinions.

5. A rotary combustion engine construction as recited in claim 4, wherein the angular distance between a spark plug and a following exhaust port is substantially twice of the angular distance between the said following exhaust port and a following intake port, and substantially equals the angular distance between the said following intake port and a subsequent spark plug following the said following intake port.

6. A rotary combustion engine construction as recited in claim 1, wherein the cylinder bore portion of each chamber is tangential to the rotation of the cylindrical block.

7. A rotary combustion engine construction as recited in claim 6, wherein the quantity of said spark plugs, the quantity of said intake ports, and the quantity of said exhaust ports are the same, the quantity of either of which is half of the quantity of said chambers defined in said cylindrical block.

8. A rotary combustion engine construction as recited in claim 6, wherein the rotational speed of said cylindrical block corresponds to the gear ratio of said toothed ring portion of said engine block and one of said pinions.

9. A rotary combustion engine construction as recited in claim 6, wherein the angular distance between a spark plug and a following exhaust port is substantially twice of the angular distance between the said following exhaust port and a following intake port, and substantially equals the angular distance between the said following intake port and a subsequent spark plug following the said following intake port.

* * * * *